United States Patent [19]

Gee et al.

[11] Patent Number: 4,477,514

[45] Date of Patent: Oct. 16, 1984

[54] METHOD FOR TREATING CELLULOSIC TEXTILE FABRICS WITH AQUEOUS EMULSIONS OF CARBOXYFUNCTIONAL SILICONE FLUIDS

[75] Inventors: Ronald P. Gee, Midland; Robert E. Kalinowski, Auburn, both of Mich.

[73] Assignee: Dow Corning Corporation, Midland, Mich.

[21] Appl. No.: 551,756

[22] Filed: Nov. 14, 1983

[51] Int. Cl.[3] ..... B32B 27/12; B05D 3/02

[52] U.S. Cl. ..... 428/264; 252/8.6; 252/8.9; 427/387; 427/389.9; 427/392; 427/393.2; 427/393.4; 428/290

[58] Field of Search ..... 427/387, 392, 393.4, 427/393.2, 389.9; 428/264, 260, 224, 274, 290; 252/8.6, 8.9

[56] References Cited

U.S. PATENT DOCUMENTS

| | | | |
|---|---|---|---|
| 3,677,810 | 7/1972 | Campbell et al. | 117/138.8 F |
| 3,812,201 | 5/1974 | Bey | 260/824 R |
| 4,211,815 | 7/1980 | Deiner | 428/290 |
| 4,365,967 | 12/1982 | Guth et al. | 8/477 |
| 4,370,365 | 1/1983 | Takamizawa et al. | 427/387 |
| 4,413,998 | 11/1983 | Guth et al. | 8/477 |
| 4,419,391 | 12/1983 | Tanaka et al. | 427/392 X |

*Primary Examiner*—Thurman K. Page

*Attorney, Agent, or Firm*—Andrew H. Ward

[57] ABSTRACT

A method for improving properties of a cellulosic textile fabric is disclosed. The fabric is first impregnated with an aqueous emulsion of a carboxyfunctional silicone fluid stabilized by a nonionic surfactant having a particular HLB value, and then heated to crosslink the carboxyfunctional silicone fluid.

23 Claims, No Drawings

METHOD FOR TREATING CELLULOSIC TEXTILE FABRICS WITH AQUEOUS EMULSIONS OF CARBOXYFUNCTIONAL SILICONE FLUIDS

BACKGROUND OF THE INVENTION

The present invention relates to a method for improving properties of cellulosic textile fabrics by treating said fabrics with aqueous emulsions of carboxyfunctional silicone fluids. The properties improved by the practice of this method include, but are not limited to, durable press properties, and stain release. The present invention further relates to cellulosic textile fabrics treated by said method.

Durable press properties are typically imparted to textile fabrics by treating said fabrics with what are commonly referred to as durable press resins. Examples of durable press resins include urea-formaldehyde, dimethylolethylene-urea, melamine-formaldehyde, and a variety of other resins.

Unfortunately, durable press resins such as these can release free formaldehyde in the process of treating textiles with said resins. Formaldehyde in the free form is thought to constitute a health hazard. Organosilicon polymers have been used in conjunction with durable press resins to improve various properties of a subsequently treated textile fabric such as the hand of the treated textile fabric, the abrasion resistance of the treated textile fabric, and the tear strength of the treated textile fabric.

U.S. Pat. No. 3,812,201, issued May 21, 1974, discloses such a use, wherein the organosilicon polymer used in conjunction with durable press resins is a carboxyfunctional silicone fluid furnished in emulsion form, the emulsion being stabilized by a nonionic surfactant having a hydrophile-lipophile balance, (hereinafter referred to as HLB value), of 13.5. When the emulsion of carboxyfunctional silicone fluid disclosed in U.S. Pat. No. 3,812,201 was used per se in treating a textile fabric, however, unsatisfactory results were obtained.

Improved stain release of a treated textile fabric is disclosed in U.S. Pat. No. 3,677,810, issued July 18, 1972, wherein stain release is achieved by the combined use of methylsilicones and polymeric carboxylic acids, especially acrylic acid derivatives and polymers thereof.

Neither of the above two references shows or makes obvious the method of the present invention, wherein aqueous emulsions of certain carboxyfunctional silicone fluids stabilized by certain nonionic surfactants have been discovered to impart to textiles treated therewith excellent durable press properties, as well as surprisingly good stain release. These improved properties are obtained without the use of durable press resins or acrylates.

Similar, and in a few cases identical aqueous emulsions are claimed as compositions of matter in copending application for patent Ser. No. 551,625, filed simultaneously herewith, and entitled "Aqueous Emulsions of Carboxyl-containing Silicone Fluids and a Method For Their Preparation", assigned to the assignee of the present invention.

BRIEF SUMMARY OF THE INVENTION

It is an object of the present invention to provide a method for improving the durable press properties of cellulosic textile fabrics. It is a further object to provide a method for improving the stain release of cellulosic textile fabrics. It is another object to provide a method for improving properties of a cellulosic textile fabric that is free from the by production of formaldehyde. It is a further object to provide an all-silicone cellulosic textile fiber treatment method that improves durable press properties at low levels of treatment.

These, and other objects which will be apparent to those skilled in the art upon consideration of the present disclosure, are realized by the method of the present invention.

Said method comprises treating cellulosic textile fabrics with an emulsion, comprising a combination of:

(A) carboxyfunctional silicone fluid;

(B) a nonionic surfactant having an HLB value of from 14.5 to 16.7; and (C) water.

DETAILED DESCRIPTION OF THE INVENTION

The present invention relates to a method for improving properties of a cellulosic textile fabric, said method comprising:

I. impregnating said cellulosic textile fabric with an aqueous emulsion, said emulsion comprising a combination of (A) 0.1 to 60 percent by weight, based on the total weight of the emulsion, of a carboxyfunctional silicone fluid having the general formula $$QMe_2SiO(Me_2SiO)_x(MeRSiO)_ySiMe_2Q$$

wherein in said formula there is 0.5 to 10 mole percent of the units (MeRSiO) present, 90 to 99.5 mole percent of ($Me_2SiO$) units present and the total number of units in the molecule is 30–300, Me is a methyl radical, R is a carboxyfunctional radical, said carboxyfunctional radical being selected from the group consisting of carboxyalkyl radicals and carboxythioalkyl radicals, Q is selected from the group consisting of R, Me and OH groups, x has a value of 27 to 297, y has a value of 1 to 30;

(B) 0.01 to 10 percent by weight, based on the total weight of the emulsion, of a nonionic surfactant having an HLB value of 14.5 to 16.7, and (C) 30 to 99.89 percent by weight, based on the total weight of the emulsion, of water, and II. applying a sufficient amount of heat to the impregnated textile fabric to render the carboxyfunctional silicone fluid crosslinked.

In another aspect, the present invention relates to cellulosic textile fabrics treated by the method of the present invention.

The carboxyfunctional silicone fluids used in the aqueous emulsions of the method of the present invention, component (A), have the general formula:

$$QMe_2SiO(Me_2SiO)_x(MeRSiO)_ySiMe_2Q,$$

wherein

Me denotes the methyl radical,

R is a carboxyfunctional radical,

Q is selected from the group consisting of R, Me, and OH groups, x has a value of from 27 to 297, and y has a value of from 1 to 30.

As referred to herein, a carboxyfunctional radical is a monovalent radical which contains the —COOH radical, and is attached to a silicon atom of the main molecular chain by a divalent linking group. Direct attachment to the silicon atom is through a silicon to carbon bond.

Divalent linking groups contemplated for use in the method of the present invention are either alkylene groups containing from 2 to 8 carbon atoms, or thioalkylene groups, containing 2 to 8 carbon atoms and one sulfur atom present as a thioether group.

Those carboxyfunctional radicals wherein the divalent linking group is an alkylene group are referred to herein as carboxyalkyl radicals; those carboxyfunctional radicals wherein the divalent linking group is a thioalkylene group are referred to herein as carboxythioalkyl radicals.

Specific examples of carboxyalkyl radicals include, but are not limited to: $—CH_2CH_2COOH$, $—CH_2CH(CH_3)COOH$,

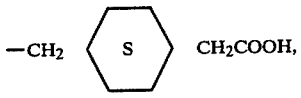

$—CH_2CH(C_2H_5)CH_2COOH$, $—CH_2CH(CH_3)CH(CH_3)CH_2COOH$, and the like. The $—CH_2CH(CH_3)COOH$ radical is a preferred carboxyalkyl radical for the practice of the method of the present invention.

Specific examples of carboxythioalkyl radicals include, but are not limited to: $—CH_2CH_2SCOOH$, $—(CH_2)_3SCOOH$, $—CH_2CH(CH_3)SCH_2COOH$, $—CH_2CH_2SCH_2COOH$, $—CH_2CH(C_2H_5)SCH_2COOH$, and the like. The $—CH_2CH_2SCH_2COOH$ radical is a preferred carboxythioalkyl radical for the practice of the method of the present invention.

The respective values of x and y in the formula above are selected such that the (MeRSiO) units constitute from 0.5 to 10 mole percent of the total number of units. More preferably, the (MeRSiO) units constitute from 1 to 5 mole percent of the total number of units. Most preferably, the (MeRSiO) units constitute from 2 to 3 mole percent of the total number of units.

The total number of units is the above formula is herein defined as the sum of the values of x plus y plus 2. The 2 is added to account for the two $QMe_2SiO_{\frac{1}{2}}$ siloxy end groups. The total number of units for carboxyfunctional silicone fluids used in the method of the present invention, is from 30 to 300. More preferably, the total number of units is from 50 to 200. Most preferably, the total number of units is from 90 to 110.

Carboxyfunctional silicone fluids as hereinabove described are well known. Many such fluids are commercially available. The synthesis of carboxyfunctional silicone fluids is also known.

For example, carboxyfunctional silicone fluids can be synthesized from silanes bearing carboxyfunctional radicals and hydrolyzable radicals.

Silanes bearing carboxyfunctional radicals and hydrolyzable radicals are commercially available. Said silanes can also be prepared by reacting appropriate unsaturated carboxyfunctional compounds with silanes bearing hydrolyzable radicals and hydride radicals. This reaction is readily catalyzed by, e.g., platinum salts, and is described in U.S. Pat. No. 2,723,987, issued Nov. 15, 1955, which patent is incorporated herein by reference to teach a method for preparing carboxyfunctional silanes. The silane starting material is selected so as to have, on average, two hydrolyzable radicals bonded thereto. Suitable hydrolyzable radicals include: halogen atoms, such as bromine, fluorine, and chlorine; alkoxy groups, such as methoxy, ethoxy, propoxy; and the like. Silanes bearing carboxyfunctional radicals, methyl groups, and hydrolyzable radicals can be hydrolyzed under appropriate, well known conditions to form carboxyfunctional methyl cyclosiloxanes. Said carboxyfunctional methyl cyclosiloxanes can be copolymerized with dimethylcyclosiloxanes using well known acid copolymerization procedures, to produce carboxyfunctional silicone fluids as hereinabove described.

The degree of polymerization of the carboxyfunctional silicone fluid can be controlled by including, in the copolymerization procedure, a disiloxane having the formula $(QMe_2Si)_2O$, or a hydrolyzable silane having the formula $QMe_2SiX$, wherein Q and Me are as previously defined, and X represents a hydrolyzable radical as hereinabove described. The disiloxane or hydrolyzable silane is included in the copolymerization in the amount appropriate to result in the desired degree of polymerization.

For example, if a degree of polymerization of 100 is desired for the carboxyfunctional silicone fluid, 1 part of $(QMe_2Si)_2O$ is included in the copolymerization for each 98 parts of carboxyfunctional methylcyclosiloxanes plus dimethylcyclosiloxanes, all on a molar basis. Similarly, 2 parts of $QMe_2SiX$ are included for each 98 parts of carboxyfunctional methylcyclosiloxanes plus dimethylcyclosiloxanes to yield a carboxyfunctional silicone fluid having an average degree of polymerization of 100, all of the above parts being on a molar basis.

The nonionic surfactants used in the aqueous emulsions of the present invention, component (B), are readily available. Said nonionic surfactants are compounds or mixtures of compounds which do not ionize in water, but possess a degree of water compatibility by reason of containing within their molecular structure oxygenated pendant molecular segments. Most commonly, said segments are polyalkylene oxide segments. The remainder of the nonionic surfactant is generally a fatty acid residue, or other fatty substance residue.

Nonionic surfactants are characterized by the well known hydrophile-lipophile balance, (HLB) values. HLB values are empirically derived. The concept of assigning HLB values was developed to describe the relative balance of water compatibility to oil compatibility in a surfactant. HLB values are generally available in manufacture's literature, and in such reference works as McCutcheon's Detergents and Emulsifiers, published annually by McCutcheon's Division, MC Publishing Co., PO Box 60, Ridgewood, NJ 07451.

The nonionic surfactants used in the aqueous emulsions of the method of the present invention are those nonionic surfactants having an HLB value of from about 14.5 to about 16.7.

Examples of suitable nonionic surfactants include, but are not limited to:

ethoxylates of linear alcohols;
ethoxylated castor oil;
polyoxyethylene lauryl ether having about 12 ethylene oxide units;
polyoxyethylene lauryl alcohol having about 12 ethylene oxide units;
ethoxylated tridecyl ether;
octylphenoxy polyethoxy ethanol;

nonylphenoxy polyethoxy ethanol;
polyoxyethylene sorbitan monolaurate;
polyoxyalkylated isostearyl alcohol;
polyoxyethylene sorbitan monostearate;
ethoxylated oleyl alcohol;
ethoxylated sorbitan monooleate;
ethoxylated lanolin alcohol;
acetylated polyoxyethylene derivative of lanolin having about 9 ethyleneoxide units;
alkylarylpolyethylene glycol ether;
polyoxyethylene stearyl cetyl ether having about 20 ethylene oxide units;
polyoxyethylene sorbitan monopalmitate;
polyoxyethylene cetyl ether;
polyoxyethylene sorbitol lanolin derivatives; condensates of ethylene oxide with a hydrophobic base formed by condensing propylene glycol with propylene oxide;
and the like.

Two or more surfactants as hereinabove described can be mixed, provided that the HLB of the resulting mixture is within the recited range. One, some, or all of said surfactants can be outside the recited HLB range, provided that the HLB of the resulting mixture is within the recited range.

The water used as component (C) of the aqueous emulsions of the present invention should be relatively pure, although water from any reasonable source can be used if said water does not contain excessive amounts of mineral, chemical, or particulate impurities.

The amount of carboxyfunctional silicone fluid to be used in the aqueous emulsions of the method of the present invention is from 0.1% to 60% by weight, based on the total weight of the emulsion.

The amount of nonionic surfactant to be used in the aqueous emulsions of the present invention is from 0.01% to 10% by weight, based on the total weight of the emulsion.

The amount of water to be used in the aqueous emulsions of the present invention is from 30% to 99.89% by weight, based on the total weight of the emulsion.

It is preferred to store and ship the aqueous emulsions of the method of the present invention in a relatively more concentrated form with respect to components (A) and (B). Thus, a preferred aqueous emulsion for storage and/or shipping contains 1.5 to 60% component (A), 0.2 to 10% component (B), and 30 to 98.3% component (C), all percentages by weight based on the total weight of the emulsion.

It is preferred to use the aqueous emulsion in the method of the present invention in more dilute form. For example, a preferred range for dilute aqueous emulsions is:

0.5 to 2% component (A);
0.05 to 0.2% component (B); and
98.3 to 98.45% component (C), all of the above percentages being by weight, based upon the total weight of the emulsion.

It will be recognized that a more concentrated emulsion, more suitable for shipment or storage, can be rendered more dilute, and thus more suitable for use in treating textile fabrics, by adding appropriate amounts of water to the more concentrated emulsion.

Certain combinations of surfactant HLB value and carboxyfunctional silicone fluid have been found to provide especially good improvement of properties of cellulosic textile fabrics treated therewith, and thus said combinations are used in preferred embodiments of the present invention.

A first preferred embodiment is to use an aqueous emulsion having a carboxyfunctional silicone fluid containing carboxythioalkyl radicals, in combination with a nonionic surfactant having an HLB value of 14.5 to 15.0. Said first preferred embodiment provides cellulosic textile fabrics with especially good durable press properties and stain release properties.

A second preferred embodiment comprises the use of a combination of a carboxyfunctional silicone fluid containing carboxyalkyl radicals with a nonionic surfactant having an HLB value of about 15.6 to 16.0. This second preferred embodiment provides cellulosic textile fabrics with especially good durable press properties.

A third preferred embodiment comprises the use of a combination of a carboxyfunctional silicone fluid containing carboxythioalkyl radicals with a nonionic surfactant having an HLB value of 16.2 to 16.5. This third preferred embodiment provides cellulosic textile fabrics with especially good stain release properties.

The aqueous emulsions of the method of the present invention are made by mixing together the appropriate amounts of the three components hereinabove described, and exposing the resulting simple mixture of three components to sufficient shearing forces to disperse the carboxyfunctional silicone fluid into particles less than about 2.0 microns in diameter. More preferably, the simple mixture is exposed to sufficient shearing forces that the carboxyfunctional silicone fluid is dispersed into particles less than about 1.0 micron in diameter.

Three general techniques are contemplated for making the aqueous emulsions of the method of the present invention. In a first general technique, the carboxyfunctional silicone fluid, nonionic surfactant, and water are mixed by hand or by a suitable mechanical mixer, producing a simple mixture. Said simple mixture is then exposed to sufficient shearing forces to disperse the carboxyfunctional silicone fluid into particles less than about 2.0 microns in diameter, and preferably less than about 1.0 micron in diameter.

In a second general technique, the carboxyfunctional silicone fluid, nonionic surfactant, and water are simultaneously exposed to sufficient shearing forces to disperse the carboxyfunctional silicone fluid into particles less than about 2.0 microns, and preferably less than about 1.0 micron in diameter.

In a third general technique, the nonionic surfactant and water are mixed together, and then the carboxyfunctional silicone fluid is added to the mixture of nonionic surfactant and water. The simple mixture thus obtained is then exposed to sufficient shearing forces to disperse the carboxyfunctional silicone fluid in particles less than about 2.0 microns, and preferably less than about 1.0 micron in diameter. Other techniques will be apparent to those skilled in the art.

Means for exposing the three components of the aqueous emulsions of the method of the present invention to sufficient shearing forces are well known and readily available. Emulsification equipment, such as colloid mills, homogenizers, sonic energy generators, and the like, can be used as the means for exposing the three components of the aqueous emulsions of the present invention to sufficient shearing forces.

The amount of shearing force that the simple mixture is exposed to is generally adjustable when using such equipment. For example, the gap through which the simple mixture is forced in using a colloid mill is adjustable. The narrower said gap is, the greater the shearing forces imposed upon the simple mixture are. A gap setting of 0.25 mm (0.01 inch) is a representative gap setting for a colloid mill when making the aqueous emulsions of the method of the present invention.

The time of exposure to shearing forces that is sufficient to disperse the carboxyfunctional silicone fluid in particles less than about 2.0 microns in diameter can vary widely, depending on the rate at which the equipment operates, relative to the total volume of simple mixture being emulsified. In general, a time such that the total volume of the simple mixture can pass through the equipment one time, is the minimum sufficient time.

Thus, in a colloid mill operating at a rate of 100 liters/minute, 1 minute will be the minimum sufficient time for making an emulsion from a simple mixture having a total volume of 100 liters.

In the case of sonic energy generators, the minimum sufficient time can be determined through routine experimentation.

Exposure to sufficient shearing forces is continued until the average particle size of dispersed carboxyfunctional silicone fluid is less than about 2.0 microns, and preferably until said particle size is less than about 1.0 micron in diameter.

Particle size can be determined by such well known procedures as microscopic examination, or hydrodynamic chromatography.

Non-critical components can be added to the aqueous emulsion at an appropriate time. Examples of such non-critical components include, but are not limited to, perfumes, colorants, dyes, brighteners, and the like. Such non-critical components can be added at an appropriate time so long as they do not destabilize the aqueous emulsion or substantially inhibit the reactivity of the carboxyfunctional silicone fluid.

Cellulosic textile fabrics upon which the method of the present invention can be advantageously employed include those containing from 10% to 100% cellulosic fibers. Cellulosic fibers are those derived from cellulose or containing cellulose chains, such as cotton, rayon and acetate fibers.

The cellulosic fibers can be blended with non-cellulosic fibers, such as the well-known polyester, polyacrylonitrile, or nylon fibers in either woven or non-woven fabrics.

Impregnation of the textile fabric with the aqueous emulsion of the method of the present invention can be accomplished by spraying, such as with an aerosol, exposing a continuous web of the textile fabric to a continuous curtain of the aqueous emulsion, or preferably by immersing the textile fabric in the aqueous emulsion either continuously or in a batch operation.

It may be advantageous to squeeze the fabric free of excess aqueous emulsion in an operation such as padding, wherein the fabric is pressed between rollers to remove excess liquid.

Pickup, i.e. the amount of aqueous emulsion absorbed by the textile fabric, can be measured gravimetrically, and is expressed as the weight percentage increase of the textile fabric. The pickup suitable for the practice of the method of the present invention will vary according to the thickness and absorbency of the textile fabric and the carboxyfunctional silicone fluid content of the aqueous emulsion. For example, with a very thick cotton fabric, it might be desirable to have a pickup of 300 or 400% or more of an aqueous emulsion containing 1% carboxyfunctional silicone fluid; with a thin 15% cotton, 85% polyester textile fabric, a pickup of 50 or 25%, or less, of an aqueous emulsion containing 1% carboxyfunctional silicone fluid may be sufficient.

After impregnation and padding, if a padding step is included, it may be convenient to include a drying step to facilitate handling of the impregnated textile fabric. Such a drying step can be conducted at temperatures of from 20° C. to 150° C. for times of 10 seconds to several days, said times depending upon the temperature selected. Thus, at 150° C., a drying time of 5 minutes will generally be sufficient, while at 20° C. 1 or 2 days might be necessary. Drying is optional and not critical, but if it is desired to subsequently press a crease or smooth area into the textile fabric, care should be taken to avoid crosslinking the carboxyfunctional silicone fluid during the drying step. Crosslinking may be avoided in a drying step by holding the impregnated textile fabric at a given temperature within the above range for the minimum time necessary to substantially complete the evaporation of the water.

Crosslinking of the carboxyfunctional silicone fluid deposited upon the textile fabric is accomplished by heating said impregnated textile fabric. Temperatures from about 100° C. to about 280° C. for from 30 minutes to 5 seconds can accomplish crosslinking, wherein 30 minutes is an appropriate time at 100° C. and 5 seconds is an appropriate time at 280° C.

Combinations of time and temperature from 5 minutes at 150° C. to 10 seconds at 220° C. are preferred in the practice of this invention for most textile fabrics.

It will be apparent to those skilled in the art that combinations of time and temperature that can be expected to degrade the textile fabric are to be avoided.

Crosslinking as referred to herein means to render the carboxyfunctional silicone fluid substantially non-removable from the treated fabric when extracted with aqueous detergent solutions. Thus a treated textile fabric wherein the carboxyfunctional silicone fluid is properly crosslinked will maintain substantially the same durable press properties through at least two subsequent home laundry cycles as specified in American Association of Textile and Colorant Chemists Standard 124-1975 (hereinafter AATCC).

The following examples are herein presented to allow those skilled in the art to better understand the preparation of the aqueous emulsions used in the method of the present invention, and to better understand the use of said emulsions in the method for treating cellulosic textile fabrics. These examples are illustrative, and are not intended to limit the present invention.

Parts and percentages in the following examples are by weight unless otherwise specified. The term Me in the following examples represents the methyl radical.

Pressures reported herein were measured in pounds per square inch, (psi), and converted to Pascals by multiplying the value obtained in psi by $6.89\times10^3$ Pa/psi and rounding the result of said multiplication to three significant figures.

Test Procedures: The following test procedures were used herein to evaluate properties of treated textile fabrics.

Durable Press Rating: AATCC Test Method 124-1975. Durable press ratings reported herein were evaluated as set forth in the above standard.

A series of standardized, wrinkled fabric samples for comparison were obtained, said samples being furnished with ratings from 1 to 5. A value of 1 represents the degree of wrinkling displayed by a pure, untreated cotton fabric, and a value of 5 represents a totally wrinkle free fabric.

Each sample to be evaluated was matched with the standardized sample it most nearly resembled with respect to the number and severity of wrinkles. Each sample tested was then assigned the value corresponding to that standardized sample which it most nearly resembled. An average of at least two independent results for each sample was obtained in this manner, and the results were averaged.

Durable press ratings in some of the following examples were measured both before and after the sample under test was subjected to five laundering cycles as set forth in the hereinabove mentioned AATCC standard.

Water Drop Holdout: A single drop of water was placed upon the fabric being tested, and the time the water drop took to soak into the fabric was measured and recorded.

Stain Release: Stain release was evaluated herein by the stain release test. Textile fabrics were exposed independently to each of 5 test substances: 200 oil, which is a highly viscous gear oil composition; mineral oil; vegetable oil; mustard; and butter. The exposed textile fabrics were laundered twice, and rated from 1 to 5. A rating of 5 represented total disappearance of the stain and 1 represented no diminution of the stain. The rating for each substance was determined by at least two different observers, the ratings were averaged, and then the averages were summed for the 5 substances. Thus a sum of 25 indicates ideal stain release and a sum of 5 indicates total lack of stain release.

EXAMPLE 1

An aqueous emulsion was prepared from the following components:

| | |
|---|---|
| INSERT RING | 35.0 parts |
| Octylphenoxy polyethoxyethanol, having an HLB value of 14.6 | 4.6 parts |
| water | 60.4 parts |

The octylphenoxy polyethoxyethanol was added to the water, and the resulting mixture was stirred for approximately 15 minutes with a mechanical mixer.

After the 15 minutes had elapsed, the carboxyfunctional silicone fluid was added. The resulting three component mixture was stirred for another hour.

After having been stirred for the hour, the mixture of three components was passed twice through a homogenizer, at a pressure of $4.82\times10^7$ Pa (7000 psi) on the first pass, and at a pressure of $2.10\times10^7$ Pa (3000 psi) on the second pass.

The resulting aqueous emulsion was diluted with additional water until the carboxyfunctional silicone fluid constituted 0.8% of the total emulsion. This diluted emulsion was then used as a textile treatment bath.

A textile fabric comprised of 65% polyester fibers and 35% cotton fibers was impregnated by immersion in the textile treatment bath prepared hereinabove, and then padded at a pressure of approximately $2.75\times10^4$ Pa (40 psi). Weight pickup of approximately 100% was determined gravimetrically.

The impregnated, padded fabric was then secured to a frame and placed in an air-circulating oven set at a temperature of 105° C., where it was allowed to remain for about 5 minutes. After removal of the fabric and frame from the oven, the fabric appeared substantially dry.

The dry fabric and frame were then placed in another air-circulating oven set at a temperature of 200° C., where they were allowed to remain for 20 seconds, thereby crosslinking the carboxyfunctional silicone fluid.

After the 20 seconds had elapsed, the fabric and frame were removed from the oven and allowed to come to room temperature. The room temperature fabric was then removed from the frame, and evaluated by the test procedure hereinabove described. The results of this evaluation are set forth in Table 1.

EXAMPLES 2–14

The procedures of Example 1 were followed for each of the following listed formulations.

Each aqueous emulsion was prepared as described in Example 1 and diluted with additional water to provide a treatment bath comprising 0.8% by weight carboxyfunctional silicone fluid. In each case, a textile fabric as described in Example 1 was treated by the procedure set forth in Example 1. Each treated fabric was then evaluated. See Table 1.

EXAMPLE 2

| | |
|---|---|
| carboxyfunctional silicone fluid of Example 1 | 35.0 parts |
| mixture of two octylphenoxy polyethoxy ethanols, said mixture having an HLB value of 14.5 | 3.5 parts |
| water | 61.5 parts |

EXAMPLE 3

| | |
|---|---|
| carboxyfunctional silicone fluid of Example 1 | 35.0 parts |
| mixture of two octylphenoxy polyethoxyethanols, said mixture having an HLB value of 15.0 | 3.5 parts |
| water | 61.5 parts |

EXAMPLE 4

| | |
|---|---|
| carboxyfunctional silicone fluid of Example 1 | 35.0 parts |
| polyoxyethylene stearyl ether, having an HLB value of 15.3 | 4.6 parts |
| water | 60.4 parts |

EXAMPLE 5

| | |
|---|---|
| carboxyfunctional silicone fluid of Example 1 | 35.0 parts |
| polyoxyethylene oleyl ether, having an HLB value of 15.3 | 3.5 parts |
| water | 61.5 parts |

EXAMPLE 6

| | |
|---|---|
| carboxyfunctional silicone fluid of Example 1 | 35.0 parts |
| mixture of octylphenoxypolyethoxyethanols, said mixture having an | 3.5 parts |

-continued

| | |
|---|---|
| HLB value of 15.5 | |
| water | 61.5 parts |

EXAMPLE 7

| | |
|---|---|
| carboxyfunctional silicone fluid of Example 1 | 35.0 parts |
| octylphenoxypolyethoxyethanol having an HLB value of 15.8 | 3.5 parts |
| water | 61.5 parts |

EXAMPLE 8

| | |
|---|---|
| carboxyfunctional silicone fluid of Example 1 | 35.0 parts |
| mixture of octyphenoxy polyethoxyethanols, said mixture having an HLB value of 16.0 | 3.5 parts |
| water | 61.5 parts |

EXAMPLE 9

| | |
|---|---|
| carboxyfunctional silicone fluid of Example 1 | 35.0 parts |
| ethoxylated tridecyl ether, having an HLB value of 16.0 | 4.6 parts |
| water | 60.4 parts |

EXAMPLE 10

| | |
|---|---|
| carboxyfunctional silicone fluid of Example 1 | 35.0 parts |
| mixture of octylphenoxypolyethoxy-ethanols, said mixture having an HLB value of 16.5 | 3.5 parts |
| water | 61.5 parts |

EXAMPLE 11

| | |
|---|---|
| INSERT RING | 35.0 parts |
| octylphenoxypolyethoxyethanol having an HLB value of 15.8 | 4.6 parts |
| water | 60.4 parts |

EXAMPLE 12

| | |
|---|---|
| INSERT RING | 35.0 parts |
| octylphenoxy polyethoxyethanol having an HLB value of 14.7 | 4.6 parts |
| water | 60.4 parts |

EXAMPLE 13

| | |
|---|---|
| INSERT RING | 35.0 parts |
| octylphenoxy polyethoxyethanol having an HLB value of 15.8 | 4.6 parts |
| water | 60.4 parts |

EXAMPLE 14

| | |
|---|---|
| INSERT RING | 35.0 parts |
| octylphenoxy polyethoxyethanol having an HLB value of 14.7 | 4.6 parts |
| water | 60.4 parts |

TABLE I

| Example | Nonionic Surfactant HLB | Durable Press Rating: Initial | Durable Press Rating: After 5 laundry cycles | Water drop Holdout | Stain Release Rating |
|---|---|---|---|---|---|
| 1 | 14.6 | 3.4 | 3.6 | 31 seconds | 19.0 |
| 2 | 14.5 | 3.8 | — | >60 seconds | 20.5 |
| 3 | 15.0 | 4.0 | — | 55 seconds | 20.3 |
| 4 | 15.3 | 3.2 | 3.6 | >60 seconds | 17.0 |
| 5 | 15.3 | 3.2 | 3.1 | >60 seconds | 17.5 |
| 6 | 15.5 | 3.7 | — | >60 seconds | 18.3 |
| 7 | 15.8 | 3.8 | 3.5 | 30 seconds | 18.0 |
| 8 | 16.0 | 4.0 | — | 55 seconds | 21.3 |
| 9 | 16.0 | 3.1 | 3.5 | 45 seconds | 17.3 |
| 10 | 16.5 | 3.4 | — | 60 seconds | 21.3 |
| 11 | 15.8 | 4.0 | — | — | — |
| 12 | 14.7 | 3.6 | — | — | — |
| 13 | 15.8 | 3.5 | — | — | — |
| 14 | 14.7 | 3.2 | — | — | — |

That which is claimed is:

1. A method for improving properties of a cellulosic textile fabric, said method comprising I. impregnating said cellulosic textile fabric with an aqueous emulsion, said emulsion comprising a combination of (A) 0.1 to 60 percent by weight, based on the total weight of the emulsion, of a carboxyfunctional silicone fluid having the general formula $$QMe_2SiO(Me_2SiO)_x(MeRSiO)_ySiMe_2Q$$

wherein in said formula there is 0.5 to 10 mole percent of the units (MeRSiO) present, 90 to 99.5 mole percent of ($Me_2SiO$) units present and the total number of units in the molecule is 30–300, Me is a methyl radical R is a carboxyfunctional radical, said carboxyfunctional radical being selected from the group consisting of carboxyalkyl radicals and carboxythioalkyl radicals, Q is selected from the group consisting of R, Me and OH groups, x has a value of 27 to 297, y has a value of 1 to 30;

(B) 0.01 to 10 percent by weight, based on the total weight of the emulsion, of a nonionic surfactant having an HLB value of 14.5 to 16.7, and (C) 30 to 99.89 percent by weight, based on the total weight of the emulsion, of water, and II. applying a sufficient amount of heat to the impregnated textile fabric to render the carboxyfunctional silicone fluid crosslinked.

2. The method of claim 1 wherein R is a carboxythioalkyl radical.

3. The method of claim 2 wherein the carboxythioalkyl radical is the —$CH_2CH_2SCH_2COOH$ radical and the nonionic surfactant has an HLB value of from 14.5 to 15.0.

4. The method of claim 3 wherein Q is a methyl radical.

5. The method of claim 4 wherein component (A) constitutes from 0.5 to 1.5% by weight, component (B) constitutes from 0.05 to 0.2% by weight, and component (C) constitutes from 99.45 to 98.3% by weight, all of the above percentages by weight based upon the total weight of the emulsion.

6. The method of claim 5 wherein there are 1 to 5 mole percent (MeRSiO) units present in the carboxyfunctional silicone fluid.

7. The method of claim 6 wherein there are 2 to 3 mole percent (MeRSiO) units present in the carboxyfunctional silicone fluid.

8. The method of claim 2 wherein the carboxythioalkyl radical is the —$CH_2CH_2SCH_2COOH$ radical and the nonionic surfactant has an HLB value of from 16.2 to 16.5.

9. The method of claim 8 wherein Q is a methyl radical.

10. The method of claim 9 wherein component (A) constitutes from 0.5 to 1.5% by weight, component (B) constitutes from 0.05 to 0.2% by weight, and component (C) constitutes from 99.45 to 98.3% by weight, all of the above percentages by weight based upon the total weight of the emulsion.

11. The method of claim 10 wherein there are 1 to 5 mole percent (MeRSiO) units present in the carboxyfunctional silicone fluid.

12. The method of claim 11 wherein there are 2 to 3 mole percent (MeRSiO) units present in the carboxyfunctional silicone fluid.

13. The method of claim 1 wherein R is a carboxyalkyl radical.

14. The method of claim 13 wherein the carboxyfunctional radical is the —$CH_2CH(CH_3)COOH$ radical and the nonionic surfactant has an HLB value of from 15.6 to 16.0.

15. The method of claim 14 wherein component (A) constitutes from 0.5 to 1.5% by weight, component (B) constitutes from 0.05 to 0.2% by weight, and component (C) constitutes from 99.45 to 98.3% by weight, all of the above percentages by weight based upon the total weight of the emulsion.

16. The method of claim 15 wherein there are 1 to 5 mole percent (MeRSiO) units present in the carboxyfunctional silicone fluid.

17. The method of claim 16 wherein there are 2 to 3 mole percent (MeRSiO) units present in the carboxyfunctional silicone fluid.

18. A cellulosic textile fabric treated by the method of claim 1.

19. A cellulosic textile fabric treated by the method of claim 2.

20. A cellulosic textile fabric treated by the method of claim 3.

21. A cellulosic textile fabric treated by the method of claim 8.

22. A cellulosic textile fabric treated by the method of claim 13.

23. A cellulosic textile fabric treated by the method of claim 14.

* * * * *

UNITED STATES PATENT AND TRADEMARK OFFICE

CERTIFICATE OF CORRECTION

PATENT NO. : 4,477,514

DATED : October 16, 1984

INVENTOR(S) : R. P. Gee and R. E. Kalinowski

It is certified that error appears in the above-identified patent and that said Letters Patent is hereby corrected as shown below:

In Col. 11, line 48, delete "INSERT RING" and substitute therefor:

-- $Me_3SiO(Me_2SiO)_{98}(MeSiO)_1SiMe_3$ --
$CH_2CH(CH_3)COOH$

In Col. 11, line 56, delete "INSERT RING" and substitute therefor:

-- $Me_3SiO(Me_2SiO)_{28}(MeSiO)_1SiMe_3$ --
$CH_2CH(CH_3)COOH$

In Col. 11, line 63, delete "INSERT RING" and substitute therefor:

--$Me_3SiO(Me_2SiO)_{94}(MeSiO)_5SiMe_3$ --
$CH_2CH(CH_3)COOH$

In Col. 12, line 4, delete "INSERT RING" and substitute therefor:

-- $Me_3SiO(Me_2SiO)_{94}(MeSiO)_5SiMe_3$ --
$CH_2CH(CH_3)COOH$

UNITED STATES PATENT AND TRADEMARK OFFICE

CERTIFICATE OF CORRECTION

PATENT NO. : 4,477,514

DATED : October 16, 1984

INVENTOR(S) : Ronald P. Gee, Robert D. Kalinowski

It is certified that error appears in the above-identified patent and that said Letters Patent is hereby corrected as shown below:

In column 9, line 39
column 11, lines 48, 56 and 66
column 12, line 4

"INSERT RING" should read

--- $Me_3SiO(Me_2SiO)_{96}(MeSiO)_2SiMe_3$ ---.
$\quad\quad\quad

UNITED STATES PATENT AND TRADEMARK OFFICE

CERTIFICATE OF CORRECTION

PATENT NO. : 4,477,514

DATED : October 16, 1984

INVENTOR(S) : R. P. Gee and R. E. Kalinowski

It is certified that error appears in the above-identified patent and that said Letters Patent is hereby corrected as shown below:

In Col. 11, line 48, delete "INSERT RING" and substitute therefor:

-- $Me_3SiO(Me_2SiO)_{98}(MeSiO)_1SiMe_3$ --
$CH_2CH(CH_3)COOH$

In Col. 11, line 56, delete "INSERT RING" and substitute therefor:

-- $Me_3SiO(Me_2SiO)_{28}(MeSiO)_1SiMe_3$ --
$CH_2CH(CH_3)COOH$

In Col. 11, line 63, delete "INSERT RING" and substitute therefor:

--$Me_3SiO(Me_2SiO)_{94}(MeSiO)_5SiMe_3$ --
$CH_2CH(CH_3)COOH$

In Col. 12, line 4, delete "INSERT RING" and substitute therefor:

-- $Me_3SiO(Me_2SiO)_{94}(MeSiO)_5SiMe_3$ --
$CH_2CH(CH_3)COOH$

UNITED STATES PATENT AND TRADEMARK OFFICE

CERTIFICATE OF CORRECTION

PATENT NO. : 4,477,514

DATED : October 16, 1984

INVENTOR(S) : R. P. Gee and R. E. Kalinowski

It is certified that error appears in the above-identified patent and that said Letters Patent is hereby corrected as shown below:

This certificate will supersede Certificate of Correction issued June 25, 1985

Signed and Sealed this

*First* Day of *October 1985*

[SEAL]

*Attest:*

*Attesting Officer*

DONALD J. QUIGG

*Commissioner of Patents and Trademarks—Designate*